US005234755A

United States Patent [19]

Okamura

[11] Patent Number: 5,234,755

[45] Date of Patent: Aug. 10, 1993

[54] WATER ABSORPTIVE AND RETENTIVE FLEXIBLE CLOTH AND METHOD FOR PRODUCING SAME

[75] Inventor: Hiroshi Okamura, Chiba, Japan

[73] Assignee: Showa Shell Sekiyu Kabushiki Kaisha, Tokyo, Japan

[21] Appl. No.: 664,118

[22] Filed: Mar. 4, 1991

[30] Foreign Application Priority Data

Mar. 6, 1990 [JP] Japan ..... 2-53996

[51] Int. Cl.[5] ..... B32B 7/00

[52] U.S. Cl. ..... 428/267; 428/252; 428/260; 428/423.5

[58] Field of Search ..... 428/260, 267, 252, 423.5

[56] References Cited

U.S. PATENT DOCUMENTS 3,534,454 10/1970 Okamura et al. ..... 28/72.2

FOREIGN PATENT DOCUMENTS 43-2228 1/1968 Japan .
45-15824 6/1970 Japan .
51-96519 8/1976 Japan .
8051041 12/1980 Japan .
64-33284 2/1989 Japan .

*Primary Examiner*—James J. Bell
*Attorney, Agent, or Firm*—Cushman, Darby & Cushman

[57] ABSTRACT

The present invention provides a novel cloth superior in water absorption and oil absorption and besides, in dehydration by using a cloth made of synthetic fibers of low water absorption such as nylon and Tetron as a base and subjecting this base cloth to processing treatment with a composite comprising collagen short fibers chemically modified with oxide of fish oil and polyurethane resin, thereby to impart water absorption property thereto.

3 Claims, No Drawings

WATER ABSORPTIVE AND RETENTIVE FLEXIBLE CLOTH AND METHOD FOR PRODUCING SAME

FIELD OF THE INVENTION

The present invention relates to a water absorptive and retentive cloth and a method for producing it.

Hitherto, chamois leathers have been used for wiping window glasses. The chamois leathers are modified with oxides of fish oils and have been used for a long time for removal of water in gasoline and wiping window glasses.

However, penetration of fish oil into hide tissue and adjustment of degree of oxidation of the fish oil are complicated and so chamois leathers are expensive and thus, are restricted in their uses. Moreover, they are superior in water absorption, but are considerably inferior to cloth in dehydration.

PRIOR ART

As an approach for solving the defects, a method was developed which comprises subjecting a raw hide to reliming and bating treatments, then removing fillers by extraction with a neutral salt solution, making hydrophobic a part of hydrophilic group of collagen by chemical modification, subsequently physically softening the tissue, and thereafter treating the resulting leather with a solution of wax or paraffin (Japanese Patent Kokoku No. 43-2228).

Leathers for wiping window glasses produced by this method have not yet overcome such defects as such as inferior dehydration or hardening at dry state. Under the circumstances, a highly water absorption collagen nonwoven fabric sheet was produced by needle punching a fiber interlocked body comprising a mixture of chrome collagen fibers obtained from natural leather scraps and natural or chemical fibers to make a nonwoven fabric and then imparting thereto water absorption and water retention properties by subjecting the nonwoven fabric to treatment with vegetable tannins (Japanese Patent Kokoku No. 45-15824). Although this fabric sheet was improved in dehydration, it was still inferior to chamois leather in water absorption and tough, and thus was not put to practical use. As another approach, a raw hide was subjected to reliming treatment for 2 days, then deliming and bating treatments, pretanning with formalin, mechanical loosening of entanglement of collagen fiber bundle, tanning with oxide of fish oil and then splitting of fibers, thereby to obtain tanned collagen short fibers. The resulting tanned collagen short fibers were superior in water absorption and oil absorption and development of uses utilizing these characteristics was expected (Hiroshi Okamura et al, "Hikaku Kagaku (Leather Chemistry)", 23, 15–19, 1977).

SUMMARY OF THE INVENTION

The object of the present invention is to provide a novel cloth superior in water absorption and oil absorption and besides, in dehydration by using a woven fabric made of synthetic fibers of low water absorption and such as nylon and Tetron for employing a fabric superior in dehydration as a base cloth and subjecting this woven fabric to processing treatment with a composite material comprising the above-mentioned collagen short fibers chemically modified with oxide of fish oil and polyurethane resin, thereby to impart water absorption property thereto.

This novel cloth is superior in flexibility, water absorption and oil absorption and is by no means inferior to the conventional chamois leather in its practical aspects and is especially effective for wiping after waxing treatment.

As mentioned above, the cloth of the present invention comprises a base cloth raised in about 0.2–0.5 mm comprising a woven cloth (or nonwoven cloth) of synthetic fibers low in water absorption, a known polyurethane elastomer and collagen fibers having superior water absorption and oil absorption and chemically modified with an oxide of fish oil. Amount of the modified collagen fibers based on the polyurethane elastomer is about 3%–15 % based on the solid content of the polyurethane.

A method for producing the modified collagen fibers used in the present invention will now be explained. That is, a raw hide was dipped in a saturated lime water (2 % of lime milk) for 2 days and then was washed with water for 30 minutes. Then, the splited hide was revolved in a drum for 30 minutes together with ammonium chloride in an amount of 3 % and warm water (35 ° C.) in an amount of 200 % based on the weight of the raw hide before washed with water until the hide was completely delimed. Then, thereto was added *Bacillus subtilis* protease in an amount of 60 PU per 1 g of the hide in terms of casein digestion power and this was allowed to act on the hide for 2 hours. Thereafter, the thus treated hide was subjected to the following formalin tanning.

| | |
|---|---|
| (Based on the weight of raw hide) | |
| Water | 150% |
| Sodium chloride | 5% |
| Revolution of drum for 5 minutes. | |
| Water | 10% |
| Formalin | 2% |

The above solution was divided to three portions and each was added at an interval of 10 minutes and then, the drum was revolved for 6 hours. Thereafter, the pH was adjusted to 8.5 with sodium carbonate, followed by revolving the drum for 2 hours and dipping was continued overnight. Then, the hide was washed with water for 10 minutes. The thus tanned raw hide was put in a net drum and was dried by passing slightly warm air while revolving the drum to the half-dried state of about 45 % in water content and subjected to disintegration treatment by a disintegrating machine, namely, the half-dried modified leather was passed several times between a pair of rolls which revolved 13 times and 16 times per minute in opposite directions to each other, respectively and which were wound by special card cloth, whereby the fiber bundle was sufficiently disintegrated.

The raw hide subjected to the disintegration treatment was modified with the following solution containing higher aldehyde prepared by oxidation of fish oil.

| | | |
|---|---|---|
| Water | 200% | (based on the weight of raw hide subjected to disintegration treatment) |
| Fish oil oxide | 10% | (based on the weight of raw hide subjected to disintegration treatment) |
| Fish oil (cod oil) | 30% | (based on the weight of |

-continued

| | | |
|---|---|---|
| | | raw hide subjected to disintegration treatment) |
| Oleic acid | 10% | (based on the weight of fish oil used) |
| Copper oleate | 1% | (based on the weight of fish oil used) |
| Sodium carbonate | 0.5% | (based on the weight of raw hide subjected to disintegration treatment) |

The raw hide was revolved in a drum at 6 rpm for 6 hours.

The above fish oil oxide was prepared by adding 8 % of oleic acid and 0.5 % of copper oleate to fish oil (cod oil), passing wet air through the mixture and keeping the mixture for 24 hours at 60 ° C. to perform oxidation.

After completion of modifying, the hide was taken out from the drum and dried and then, its weight was measured. Thereafter, the leather was revolved in a drum together with 1000 % of warm water (40 ° C.), 4 % of sodium carbonate and 1 % of nonionic surface active agent based on the weight of the dried leather for 2 hours then washed with water.

The thus treated leather was subjected to simultaneous beating and drying by a remodeled small opener and water content thereof was adjected to 30%–40 % and immediately thereafter, the leather was passed through a splitting machine to obtain a modified collagen fibers.

The present invention is characterized in that a raised base cloth comprising chemical fibers poor in hydrophilicity is dipped in a processing solution containing the above-mentioned modified collagen fibers to form a soft layer thereon, the soft layer being a composite of urethane and modified collagen, thereby to impart water absorption property to the thus treated cloth material.

EXAMPLE 1

Surface of a nylon tricot-cloth (basis weight: 140 g; width: 140 cm; thichness: 0.55 mm) was subjected to raising treatment of 0.3 mm and back side of the cloth was slightly raised by buffing.

To 1 kg of a 33 % solution of polyurethane elastomer (T.G.I. type) in dimethylformamide were added 250 g of synthetic rubber and further a suitable amount of dimethylformamide and the mixture was sufficiently stirred to carry out dissolution. Into the solution was gradually incorporated 300 g of collagen short fibers modified with the fish oil oxide prepared by the method mentioned above, followed by stirring.

This mixed solution was put in a dipping bath and the raised base cloth was dipped therein. Then, the cloth was passed between squeeze rolls the final amount of resin adhering thereto reached 35±10 % (by weight) based on the base cloth. Thereafter, the cloth was introduced into a reaction water bath to fix the urethane-modified collagen fiber composite in the base Subsequently, the cloth was washed in a water bath and a softening agent was added thereto and then, the cloth was washed with warm water. The thus processed cloth was dried by a dryer at 130 ° C. and then, both sides of the cloth were subjected to a light buffing treatment by a sand paper to cause napping, thereby to obtain a highly water absorptive cloth having suede appearance and having finishing width of 121 cm, a basis weight of g and a thickness of 0.62 mm.

The cloth (10 samples with 2 m in width) was subjected to leather test (JIS K 6554) to obtain the following values of properties.

| | |
|---|---|
| Tensile break load: | 5.84 ± 0.32 kgf (6.62 ± 0.46 kgf) |
| Tensile strength: | 0.79 ± 0.04 kgf/mm$^2$ (0.89 ± 0.06 kgf/mm$^2$) |
| Elongation at breakage: | 67.7 ± 3.7% (52.1 ± 4.1%) |
| Tearing load: | 2.61 ± 0.27 kgf (3.44 ± 0.18 kgf) |
| Tearing strength: | 3.52 ± 0.34 kgf (4.65 ± 0.22 kgf) |
| Bending resistance: | 143.7 ± 6.4 mgf (167.2 ± 6.4 kgf) |

The value in the parentheses is a measured value in the lengthwise direction.

Water absorption was measured in the following manner: A rectangular sample of 40×100 mm was dipped in distilled water and difference in the weight of the sample before and after dipping was expressed by percent based on the weight of the sample before dipping. This was referred to as water absorption (I). The dipping time was 30 minutes and dipping temperature was 20±2 ° C.

Furthermore, the sample was applied with a load of 5 kg and was passed between twin rolls to squeeze water and the weight of the sample was measured (water absorption (II)). After the sample was dehydrated by centrifugation at 3,000 rpm, the weight of the sample was further measured (water absorption (III)). These weights were expressed by percent based on the weight before dipping and these were referred to as water absorptions (II) and (III), respectively.

The results were as follows:
Water absorption (I): 372±41%
Water absorption (II): 56±14%
Water absorption (III): 47±9%

When cotton was used as the base fabric, the results were as follows:
Water absorption (I): 329±43%
Water absorption (II): 136±2%
Water absorption (III): 71±12%

Water absorption of chamois leather were as follows:
Water absorption (I): 281±37%
Water absorption (II): 187±27%
Water absorption (III): 92±11%

Thus, the dehydration effect was improved by limiting the base cloth to a woven cloth of synthetic fibers and as a result, water absorption and dehydration of the cloth according to the present invention were improved.

EXAMPLE 2

Water absorption of cloths when only the base cloth was changed is shown below.

Cotton (knitted fabric, etc.):
Water absorption (I): 357±37%
Water absorption (II): 160±18%
Water absorption (III): 67±8%

Vinylon:
Water absorption (I): 338±31%
Water absorption (II): 77±14%
Water absorption (III): 47±6%

Polyester:
Water absorption (I): 332±37%
Water absorption (II): 89±17%
Water absorption (III): 45±6%

Tetron nylon high-tenacity rayon blend fabric:
Water absorption (I): 347±32%
Water absorption (II): 147±20%

Water absorption (III): 62±9%

I claim:

1. A water absorptive and retentive cloth which comprises a raised cloth base and a composite material thereon, said composite material comprising a polyurethane elastomer and chemically modified collagen short fibers which are obtained by treating a raw hide with a fish oil oxide and then splitting the thus treated raw hide into fibers.

2. A cloth according to claim 1, wherein said base cloth is made of synthetic low water absorptive cloth.

3. A water absorptive and retentive cloth according to claim 2, wherein said base cloth comprises nylon.

* * * * *

UNITED STATES PATENT AND TRADEMARK OFFICE

CERTIFICATE OF CORRECTION

PATENT NO. : 5,234,755
DATED : August 10, 1993
INVENTOR(S) : Okamura

It is certified that error appears in the above-indentified patent and that said Letters Patent is hereby corrected as shown below:

Column 6, claim 3, line 6, after "nylon" but before"." insert --or polyethylene terephtholate fibers.--

Signed and Sealed this

Twenty-second Day of February, 1994

*Attest:*

Bruce Lehman

BRUCE LEHMAN

*Attesting Officer*

*Commissioner of Patents and Trademarks*